United States Patent [19]

Zonco et al.

[11] 4,419,871

[45] Dec. 13, 1983

[54] FULLING MACHINE FOR TEXTILE MATERIAL IN CONTINUOUS ROPE FORM OR IN HOSE FORM

[75] Inventors: Placido Zonco; Maurizio Zonco, both of Pray Biellese, Italy

[73] Assignee: Zonco Federico & Figlio di Federico, Pietro e Placido Zonco S.n.c., Pray Biellese, Italy

[21] Appl. No.: 326,369

[22] Filed: Dec. 1, 1981

[30] Foreign Application Priority Data

Dec. 15, 1980 [IT] Italy ..... 26656 A/80

[51] Int. Cl.[3] ..... D06B 3/24

[52] U.S. Cl. ..... 68/22 R; 68/177; 26/21; 26/24

[58] Field of Search ..... 68/177, 178, 22 R; 26/21, 24

[56] References Cited

U.S. PATENT DOCUMENTS

| | | | |
|---|---|---|---|
| 537,170 | 4/1895 | Preston | 26/21 |
| 2,442,742 | 6/1948 | Morrill | 26/21 |
| 3,475,927 | 11/1969 | Bertoldi | 26/21 X |

FOREIGN PATENT DOCUMENTS

| | | | |
|---|---|---|---|
| 1411323 | 8/1965 | France | 68/177 |
| 1334088 | 10/1973 | United Kingdom | 26/21 |

*Primary Examiner*—Stephen Marcus
*Assistant Examiner*—Joseph M. Pitko
*Attorney, Agent, or Firm*—Holman & Stern

[57] ABSTRACT

In a fulling machine an introductory channel is provided between the paired presser and dragger rollers and the conventional pusher for the fulling plate, and a supplementary pusher unit is provided in the introductory channel having safety means to prevent overloads, the reciprocation of the supplementary pusher unit being properly synchronized with the reciprocation of the conventional pusher.

6 Claims, 3 Drawing Figures

FULLING MACHINE FOR TEXTILE MATERIAL IN CONTINUOUS ROPE FORM OR IN HOSE FORM

BACKGROUND OF THE INVENTION

1. Field of the Invention

This invention relates to a fulling machine for textile materials in continuous rope or hose form, said machine being adapted not only to effect fulling operations, but also the washing of textile materials.

Inasmuch as the invention is mainly described by the component parts of the machine which effect fulling, reference will be to fulling machines exclusively, even though it is understood that the invention can be embodied to carry out combined or separate fulling and washing runs.

2. Description of the Prior Art

It is known that the fulling operation is intended for compacting the textile materials, that is, to induce a shortening of the piece length and a shrinkage of the fabric width. In the present patent, the lengthwise fulling operation will be principally dealt with.

Is is necessary, moreover, to establish that the term "textile material in continuous rope form" is used herein to connote a fabric piece having a certain length, the starting and the ending edge whereof are sewn together and united to form an endless annular band which is twisted like a rope (also called a strand). The rope form is thus distinguished from the form that an extended fabric piece usually has. The term "textile material in hose form" is used herein to distinguish a fabric piece having a certain length which is united, at the outset, by sewing it along its side edges or selvedges to form a hose-like structure, an annular rope being then formed as in the case referred to above. It is apparent that the processing in the hose form is more cumbersome and expensive than that in continuous rope form since it requires a supplementary sewing step along the full length of the fabric piece.

In the rope or hose fulling mills, only a single rope or hose of textile material should be processed, but it is customary, for economical reasons, simultaneously and in parallel to process a number of endless ropes which are appropriately held separate from each other.

A conventional fulling machine is composed of a large tub having an at least partially sloping bottom wall. The principal component parts which are installed in said tub to carry out the fulling operations are as follows: two superimposed rollers which are driven to rotation about their respective axes at the same surface speed, the endless fabric bands or ropes being intended to pass therebetween, the presser roller being pressed against the dragger rollers, at least a fulling channel which tapers from the intake end to the exit end, and wherein the fabric undergoes the fulling step (compacting) in the longitudinal direction, a basin which contains the fulling liquor (usually soap suds) by which the fabric is soaked prior to being passed between the two rollers aforesaid, and a partitioning and guiding frame to keep the fabric ropes separate from each other. Members for the open-width fulling are additionally provided, and these are usually composed by a couple of jaws and like members placed immediately upstream of said superimposed paired rollers. The latter members are both of no immediate interest to the ends of the present invention so that no reference thereto will be made hereinafter.

The fabric bands coming from the tub bottom are passed through the partitioning and guiding frame, are imbided with the fulling liquor, are passed between the superimposed and driven rollers and are fed forward thereby into and through the fulling channel to be compacted and are then arranged in laps on the sloping bottom wall of the tub to be fed back to the partitioning and guiding frame again.

The motive members which cause the continuous run of the endless fabric bands in the tub are thus only the superimposed rollers which also fulfil the task of urging the fabric through the fulling channel. The result is that the presser roller must be urged against the dragger roller with such a force as to overcome the drag of the fulling channel, because, otherwise, a slippage of the fabric would be originated between the two rollers and this might be conducive to scars and tears in the fabric.

Too high a pressure between the two rollers may cause serious damages to the fabric, especially if the fabric is in the rope form, and such damages appear in the form of the so called marblings or creases which sometimes cannot be removed. When operating in the hose form, conversely, it is possible to redress this shortcoming at least partially: in such a case, however, the increase cost for such a processing run must be taken over, as outlined above.

It has already been suggested, also, to provide, downstream of the couple of rollers a first fulling channel, with a fulling plate, in which the fabric was introduced by the rollers prior to reaching a second fulling channel, and to provide a special thrust member adapted to cause the fabric to be fed forward into the second fulling channel. Also in this case, the thrust into the first fulling channel was produced by the pressure between the two rollers and thus such a pressure had to be, of necessity, very high, whereby the defects outlined above, such as marblings and fabric creases were incurred and the hose form fulling had to be resorted to: in spite of all these precautions, the linear speed of the fabric was unsatisfactorily low.

BRIEF SUMMARY OF THE INVENTION

An object of the present invention is thus to provide an improved fulling machine which is capable of processing fabrics in the continuous rope form (without excluding a hose form run a priori) without being impaired by the defects of marblings and creases and those of scars and tears in the processed fabrics, while concurrently permitting that a very high linear speed of the fabric being processed may be achieved.

In order that these objects may be achieved, the invention provides a fulling machine with a pair of rollers, a first fulling channel and a second fulling channel in which a reciprocable pusher member is active, characterized in that the first channel is an introductory channel through which the fabric is merely conveyed and in that, in said introductory channel, the action of a pusher member is provided for the forced feed of the fabric exiting the rollers towards the intake mouth of the second channel which is the fulling channel proper, said pusher member which is active in the introductory channel being synchronized in its reciprocation with the reciprocation of the pusher member which is active in the fulling channel so as to be positioned in registry with the exit end of the introductory channel as the pusher member of the fulling channel proper is in the position where it establishes a free communication between the introductory channel and the intake mouth of the fulling channel and so as to be in such a position as to clear the introductory channel as the pusher member of the fulling channel has penetrated said latter channel.

By virtue of the provision of a forced feed in the introductory channel, it becomes possible to work by applying a very low pressure of the presser roller onto the dragger roller of the roller couple, that is, a pressure which just suffices to draw the fabric from the tub bottom, so that the risk of marblings and creases in the fabric is offset while concurrently permitting that the paired rollers may be rotated at a high speed so as to warrant a high linear speed of the fabrics being processed.

BRIEF DESCRIPTION OF THE DRAWINGS

The foregoing and other features and advantages of the invention will become more clearly apparent from the ensuring detailed description of an exemplary embodiment of the fulling machine according to the invention, with reference to the accompanying drawings, wherein.

DETAILED DESCRIPTION

Figure 1:
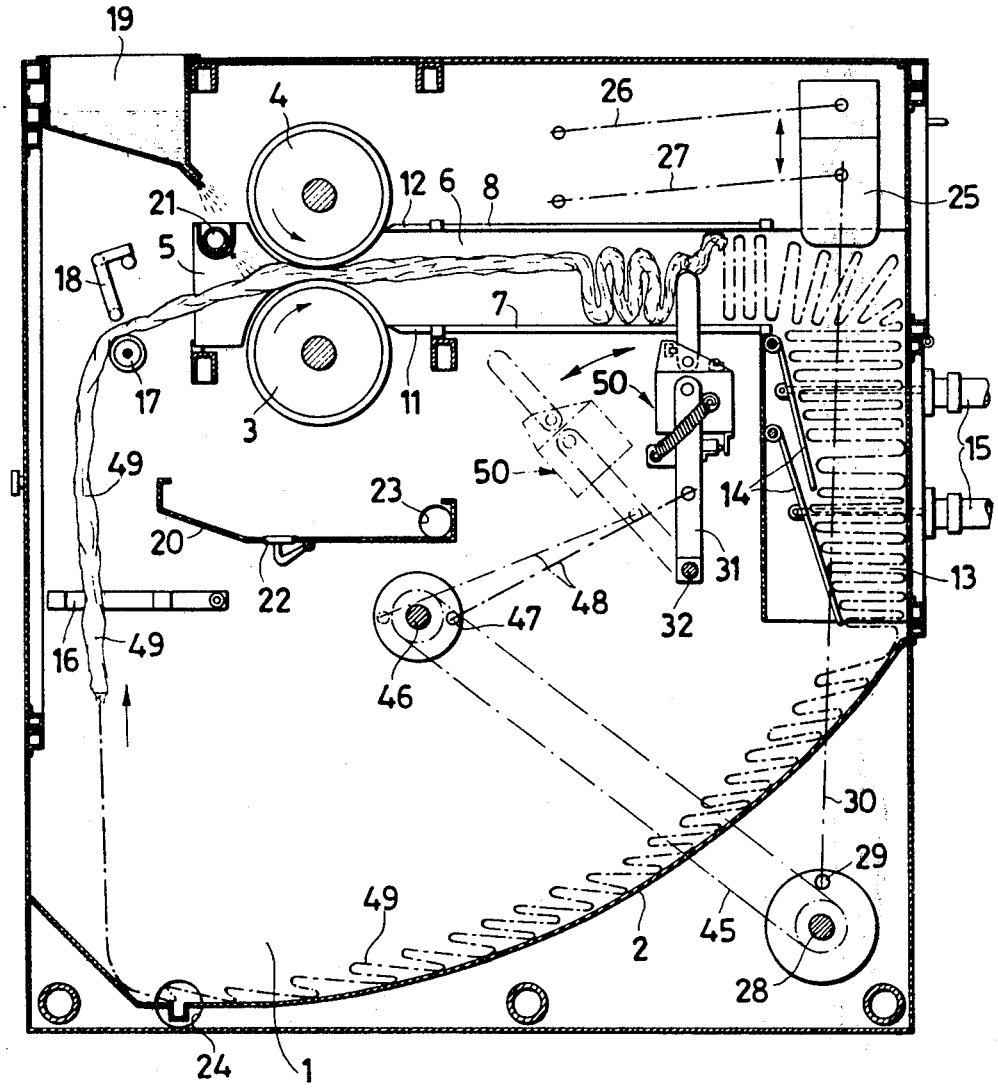
FIG. 1 is a vertical cross-sectional view showing the machine of the invention diagrammatically.

The fulling machine shown in FIG. 1, which can be used also as a washing machine, consists of a large tub, 1, having a sloping bottom wall, 2, according to a conventional layout.

In the tub 1 there is mounted a pair of superimposed rollers, with a dragger roller, 3, driven by a prime mover (not shown) for rotation about its own axis in the direction of the arrow, and a presser roller, 4, which can be driven by the dragger roller via an appropriate drive transfer mechanism (not shown), but it could also be an idler roller. The presser roller 4, is conventionally urged against the dragger roller 3 and is thus rotated at the same surface speed as the latter.

Upstream of the paired rollers 3-4, there is mounted a couple of side jaws, 5, the nip of which is adjustable for the transversal fulling: the latter step, however is not of any interest to the end of the present invention. The pair of rollers 3-4 is followed by at least an introductory channel, indicated at 6, which is composed of longitudinal upper and lower rods 8, 7 and by sidewalls 9, 10 (See FIG. 3). Close to the rollers 3-4, the longitudinal rods 7,8 of the introductory channel 6 have top and bottom doctor blades, 12 and 11, respectively, which are intended to prevent the textile material from turning away instead of entering the introductory channel 6.

In the example shown herein, the introductory channel is predominantly horizontal, and, remote from the paired rollers 3-4, it enters the fulling channel proper, 13, the latter being arranged vertically. Obviously, more than one fulling channel can be provided.

The fulling channel, 13, is confined, on a side, by the vertical wall of the tub 1, and, on the opposite side, by at least a fulling plate 14 (embodiment shown, two plates are provided, in sequential order, so as to accelerate the lengthwise fulling operation) positioned at an angle, which can be adjusted by a pneumatic jack, 15, so as to become narrower in the direction of advance of the textile material through said channel.

In the tub 1, moreover, a partitioning and guiding frame, 16, is arranged, with a guiding and accompanying cylinder 17, a rocking bar 18 having the function of a knot-feeler, and a basin 19 which contains the fulling liquor.

To use the machine as a washing device, a basin 20 is provided beneath the paired rollers 3-4 for collecting the washing bath and a sprinkler 21 for the hot and/or cold water for the finishing rinse. The basin 20 has a bath sink 22 opening into the tub 1 and a sink 23 which discharges to the outside. Lastly, also the tub 1 has a sink 24 to the outside.

The component parts described in the foregoing are common to all those which are provided in the conventional machines and can be embodied in any conventional fashion.

It should be added that in the fulling channel 13 a pusher member 25 is provided, which has the task of feeding forward the textile material exiting the introductory channel 6 through the fulling channel. For this purpose, the pusher 25 is reciprocable: its top dead center is the position in which a communication is established between the introductory channel 6 and the opening mouth of the fulling channel 13, whereas its bottom dead center is the position where said communication is cut off and the pusher 25 partially penetrates the fulling channel 13.

In the example shown, the pusher 25 is supported by arms 26, 27, which are pivoted in correspondence with the sidewalls of the tub 1 and form articulated quadrilaterals. The drive for the reciprocation of the pusher 25 is derived from a motorized reducing gear (not shown) which drives a mainshaft 28: the latter, in its turn, actuates a bilateral control (in correspondence with the two sidewalls of the tub 1) with a crank, 29, and a connecting rod, 30. Such a control mechanism, and the same is true of the supporting means including arm 26, 27 for the pusher 25, are shown schematically only, in dash-and-dot lines.

Now, according to the invention, provision is made not only for a pusher for effecting the introduction and the forward feed of the textile material into and through the fulling channel, but a second pusher unit or member is also provided.

Such a unit is generally indicated at 50 and is synchronized with the first pusher 25, and is intended to effect the forced feed of the textile material into the introductory channel 6 and the forward feed of material towards the opening mouth of the fulling channel proper 13.

This pusher unit 50 will now be described in more detail.

Figure 3:
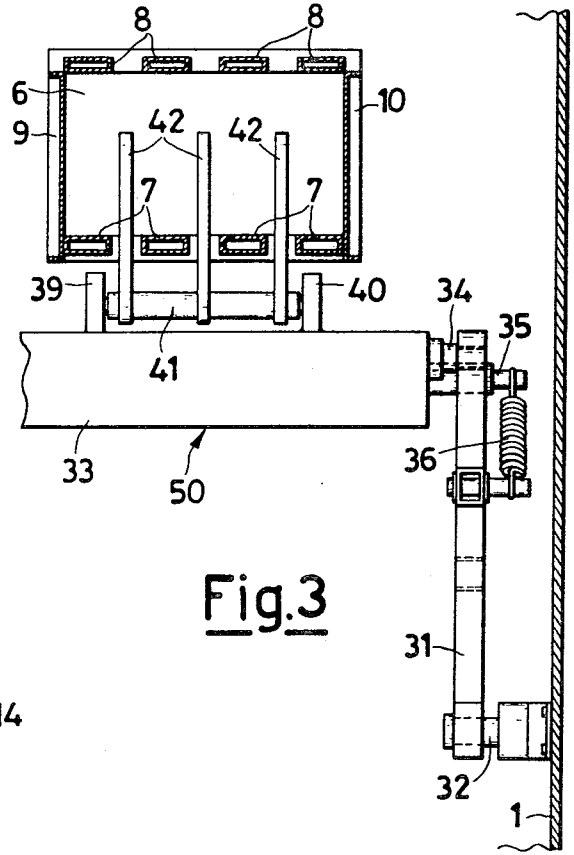
FIG. 3 is a fragmentary elevational view of the pusher member shown in FIG. 2.
Figure 2:
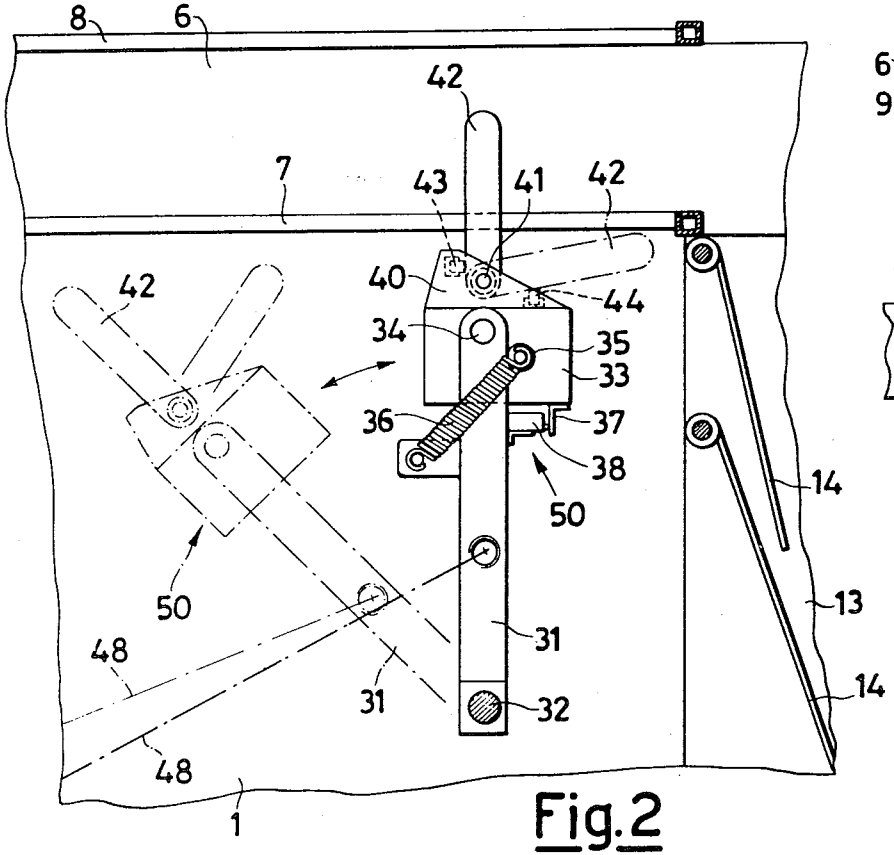
FIG. 2 is an enlarged view of the detail of the pusher member in accordance with FIG. 1 which is active in the introductory channel.

It consists of two side levers 31 which are pivoted at 32 to the sidewalls of the tub 1 and carry a cross-tie 33, which is fulcrumed, at 34, to the aforesaid levers 31. From the cross-tie 33 project pins 35 and between the latter (preferably lined by shock-absorbing materials), and the lever 31, springs 36 are mounted, which bias the pins against the respective levers 31 (as best seen in FIGS. 2 and 3), the cross-tie 33 being thus held in its operative position. In said position, a projection 37 of the cross-tie 33 keeps a microswitch 38 closed (FIG. 2). Should the cross-tie 33 be rotated counterclockwise, as viewed in FIG. 2, about the axis of the pins 34, the microswitch 38 is opened, thus cutting off the circuit through which the machine is operated, so that the machine is stopped thereby. This is a safety measure against overloads, as will be better explained hereinafter.

The cross-tie 33 carries, by the intermediary of two supporting members 39, 40, an arbor, 41, which is freely rotatable in said supporting members. The arbor 41 has, integral therewith, a certain number of arms, 42, which are adapted to be inserted between the lower longitudinal rods 7 in the introductory channel 6. Two abutment blocks, 43 and 44, integral with the supporting members 39, 40, define the two end-of-stroke positions that the arms 42 may take as a result of the rotation of the arbor 41, namely, an upright position, indicated in solid lines in FIG. 2, and a slanting forward position, indicated in dotted lines in FIG. 2.

The whole pusher unit 50 is swingable about a horizontal axis passing through the pins 32, which are the pivotal points of the unit to the sidewalls of the tub 1. The drive for this swinging motion is taken from the mainshaft 28, which also controls the reciprocation of the pusher 25. As a matter of fact, by the intermediary of a chain or a belt drive 45, or like means, the mainshaft 28 is connected to a driven shaft 46 which is rotated at the same speed as the mainshaft, and on which are mounted, in correspondence with the two sidewalls of the tub 1, cranks 47: these are connected to the levers 31 by connecting rods 48. In FIGS. 1 and 2 there have been shown, in solid lines and a dotted lines, respectively, the two end-of-stroke positions that the pusher unit 50 may take as it is moved along the directions of the arrows, as shown.

The operation of the fulling machine so described is as follows.

In FIG. 1 the route of the fabric in a closed loop is shown at 49. Preferably, the fabric is in a continuous rope form, but could also be in hose form. Usually, as outlined above, more than one fabric loop is treated, for simplifying purposes, reference will be had hereinafter to a single fabric closed loop, 49.

As it leaves the bottom wall of the tub 1, the fabric loop rises and is passed through the partitioning and guiding frame 16, which holds said loop spaced apart from the other loops, whereafter it passes over the accompanying roller 17, goes beneath the rocking rod 18 and enters the space between the lateral jaws 5. The fabric loop is soaked with the fulling liquor coming from the basin 19 and thus enters into the nip of the rollers 3 and 4.

The pressure exerted by the presser roller 4 onto the dragger roller 3 is just that which is enough to lift the fabric loop from the tub bottom and to have it moved at a linear speed which can be very fast. As a matter of fact, the fabric exiting the paired rollers 3-4 freely enters the introductory channel 6 wherein it does not find any resistance, in practice, so that it is hurled forward nearly horizontally prior to being laid in laps onto the bottom of the introductory channel, as shown in FIG. 1.

This result has been made possible by the provision of the additional pusher unit, 50, in the introductory channel 6 for forcibly feeding the fabric forward therein.

The operation of the pusher unit 50 is as follows.

Starting from the slanting backward position, indicated in dotted lines, the forward motion begins and the arms 42, arranged parallel to the side levers 31 enter the introductory channel 6 and grasp the fabric which has been stuffed therein and push it forward in laps, towards the mouth of the vertical fulling channel 13.

Concurrently, a space is originated behind the arms 42 to cause the free entrance of further fabric pushed by the paired rollers 3-4 into the introductory channel. During the forward motion of the pusher unit 50, the pusher 25 acting in the fulling channel 13 is displaced towards its top dead center and frees the mouth of the fulling channel.

If for some reasons, such as due to an excess of fabric feed by the rollers 3-4, the arms 42 are subjected, in their forward motion, to an abnormal or an exceedingly high stress, the cross-tie 33 of the pusher unit 50 would be slightly rotated in the counterclockwise direction (FIG. 2), thus resetting the microswitch 38 and stopping the machine.

As soon as the pusher unit 50 reaches its foremost position, and the return stroke is thereby started, the arms 42 are immediately tilted forward until reaching the abutment 44, whereby the fabric is prevented, in the introductory channel 6, from being pulled backwards again (see more particularly FIG. 2). As the pusher unit 50 reverts its motion once more, the arms 42 are once again automatically restored to their upright position, parallel to the levers 31.

Thus, every active stroke of the unit 50 brings about the forced advance of a portion of the fabric in laps in the introductory channel 6. This portion of the fabric enters the fulling channel 13 wherein it undergoes the action of the pusher 25, which causes the fabric to be fed forward through said tapered channel and to be subjected to the lengthwise fulling operation. The pusher 25 moves ahead, that is, it is depressed, into the fulling channel 13 as the pusher unit 50 carries out its inoperative return stroke.

By virtue of the combination of the vertically directed thrust of the pusher 25 into the fulling channel 13 and the resultant forced advance of the fabric in continuous rope form in the introductory channel 6 by the agency of the pushing unit 50, it has become possible to relieve to the utmost the pressure of the pressing roller 4 onto the dragger roller 3, so that the well known defects of fabric marblings and creased fabric are prevented, as well as abrasion and like defects, so that the fabrics are processed in continuous rope form and the added expenses of processing them in hose form are out.

Concurrently, it has become possible to increase considerably the linear speed of the fabrics being processed.

Past the fulling channel 13, the fabric is laid in laps on the sloping bottom wall 2 of the tub 1, eventually to resume its way towards the partitioning frame 16.

The necessity for the forced feed in the introductory channel 6 is otherwise apparent from the following practical example.

Assuming a surface speed of the rollers 3-4, and thus also a linear speed for the fabric, of 300 meters a minute and a number of 150 complete strokes (forward and back) of the pusher 25 acting in the fulling channel 13, said pusher must receive, at every complete stroke 2 meters of fabric in laps to be urged into the fulling channel. The time required for each advance stroke of the pusher 25 is 0.2 seconds, so that, should there be no forced feed into the introductory channel, the fabric would not reach in an adequate amount to the mouth of the fulling channel into which it is to be thrust by the pusher 25.

Safety against possible overloads can also be ensured than that shown and described hereinbefore. Instead of mounting the cross-tie 33 oscillatingly on the levers 31, it is possible to mount the set of arms 42 oscillatingly on the cross-tie 33 in which case the cross-tie must be made integral with the levers 31. Also, springs would be provided in this version, to keep the set of arms in their active position, said springs being capable of yielding as an overload is experienced to thereby cause the immediate stop of the machine.

We claim:

1. In a fulling and washing machine for textile materials in continuous rope or hose form, including a tub having side walls and an at least partially sloping bottom wall, at least one pair of superimposed presser and dragger rollers rotatably mounted above said bottom wall, means to drive each pair of rollers rotatably about their own axes at the same surface speed, said rollers being adapted to receive and cooperatively drive between the rollers of each pair continuous endless bands of fabrics in continuous rope or hose form, the presser roller being held pressed against the dragger roller, a fulling channel downstream of said rollers having an entrance opening, a further channel between each pair of rollers and the entrance opening of the fulling channel, a reciprocating pusher operatively associated with and in said fulling channel to cause the fabric to be fed forward therethrough, drive means to reciprocate said pusher, a basin containing a fulling liquor to be applied to the fabric positioned upstream of said rollers, and a partitioning and guiding frame positioned upstream of said rollers to keep the fabric endless bands spaced apart from each other, the improvement comprising said further channel is an introductory channel into which the fabric is passed from said rollers, a second pusher mounted on said tub so that it is movable in said introductory channel to engage and feed forward said fabric coming from said rollers towards said entrance opening of the fulling channel, means to reciprocate said second pusher synchronously with the reciprocation of the pusher operating in the fulling channel so that it is positioned near the exit end of said introductory channel when the pusher in the fulling channel is in a position wherein it is at least substantially withdrawn from the fulling channel to establish a free communication for said fabric between the introductory channel and the fulling channel.

2. Fulling machine according to claim 1, wherein said second pusher comprises a plurality of levers pivotally mounted on the tub sidewalls, a cross-tie connected to said levers, a pusher arm support rod mounted on and parallel to said cross-tie, at least one pusher arm mounted on said support rod, means to provide for pivotal movement of said arms so that they are adapted to enter into and withdraw from said introductory channel, abutment means operatively associated with said arm to control the positions thereof between an upright position in which said arm enters the introductory channel, and a downtilted position in which it is withdrawn from the introductory channel.

3. Fulling machine according to claim 2, wherein said cross-tie is pivotally mounted on said levers, and further comprising resilient means operatively associated with said cross-tie to yieldably hold it in a stable working position, and an electric switch operatively associated with said drive means and cross-tie to be actuated by the cross-tie to stop the machine operation when the cross-tie is shifted out of its working position.

4. Fulling machine as claimed in claim 3 wherein said plurality of levers comprises two parallel linearly extending levers pivotally mounted at one end to said tub sidewalls, said cross-tie is pivotally mounted at its ends to the other ends of said levers, an electric switch engaging projection is provided on said cross-tie, said resilient means comprises at least one helical spring connected at one end to said cross-tie and at the other end to one of said levers so that in said working position said projection engages said electric switch to maintain machine operation.

5. Fulling machine as claimed in claim 4 wherein a pair of spaced support members are mounted on said cross-tie, said pusher arm support rod comprises an axle pivotally mounted at its ends to said spaced support members, said at least one pusher arm is fixedly mounted on said axle and said abutment means comprises projections on said support members positioned to engage with and limit movement of said pusher arm, said arm being parallel with said levers in said upright position, when said cross-tie is in said stable working position, and at an angle with respect to said levers in said downtilted position wherein said arm extends from said axle in said downstream direction.

6. Fulling machine as claimed in claim 5 wherein said introductory channel comprises a plurality of spaced substantially parallel longitudinal rod-like members forming upper and lower surfaces of the channel having longitudinal slots therein, said second pusher is positioned below said introductory channel and has a plurality of said pusher arms, and said pusher arms extend through said longitudinal slots in at least said lower surface of said introductory channel when in the forward feeding position.

* * * * *